US009165732B2

(12) United States Patent
Otani et al.

(10) Patent No.: US 9,165,732 B2
(45) Date of Patent: Oct. 20, 2015

(54) GAS CIRCUIT BREAKER

(75) Inventors: Hirokazu Otani, Chiyoda-ku (JP); Toru Yamashita, Chiyoda-ku (JP); Daisuke Yoshida, Chiyoda-ku (JP); Haruhiko Koyama, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 6 days.

(21) Appl. No.: 14/119,635

(22) PCT Filed: Aug. 30, 2011

(86) PCT No.: PCT/JP2011/069661

§ 371 (c)(1),
(2), (4) Date: Nov. 22, 2013

(87) PCT Pub. No.: WO2013/030963

PCT Pub. Date: Mar. 7, 2013

(65) Prior Publication Data

US 2014/0069891 A1 Mar. 13, 2014

(51) Int. Cl.
*H01H 33/56* (2006.01)
*H01H 33/70* (2006.01)
(Continued)

(52) U.S. Cl.
CPC ..... *H01H 33/56* (2013.01); *H01H 33/7046* (2013.01); *H01H 33/14* (2013.01); *H01H 33/88* (2013.01)

(58) Field of Classification Search
CPC ..... H01H 33/08; H01H 33/91; H01H 33/901; H01H 33/903; H01H 2033/912; H01H 33/90; H01H 33/7092; H01H 33/88; H01H 33/884
USPC ..... 218/13, 14, 46, 57, 59, 60, 61, 16, 19, 218/20, 58, 63; 200/48 R; 361/120, 619
See application file for complete search history.

(56) References Cited

U.S. PATENT DOCUMENTS 4,450,330 A 5/1984 Zückler
4,596,910 A * 6/1986 Berta et al. ..... 218/19
(Continued)

FOREIGN PATENT DOCUMENTS

JP 54-091770 A 7/1979
JP 58-042126 A 3/1983
(Continued)

OTHER PUBLICATIONS

International Search Report (PCT/ISA/210) mailed on Dec. 6, 2011 by the Japanese Patent Office as the International Searching Authority for International Application No. PCT/JP2011/069661.
(Continued)

*Primary Examiner* — Renee S Luebke
*Assistant Examiner* — William Bolton
(74) *Attorney, Agent, or Firm* — Buchanan Ingersoll & Rooney PC

(57) ABSTRACT

A gas circuit breaker includes a sealed tank that includes first and second conductor containers with an insulating tube therebetween and is filled with insulating gas; a fixed arcing contact on the first conductor container side; a movable arcing contact that is provided on the second conductor container side and moves to be able to contact and separate from the fixed arcing contact; a fixed conductive contact on the first conductor container side; a movable conductive contact that moves in accordance with contact and separation of the movable arcing contact and contacts and separates from the fixed conductive contact; and a puffer unit that is provided on the second conductor container side and has a mechanical puffer chamber accommodating the movable conductive contact formed therein, wherein the puffer unit is arranged between the insulating tube and the second conductor container and is exposed to the periphery of the sealed tank.

6 Claims, 3 Drawing Sheets

(51) Int. Cl.
*H01H 33/88* (2006.01)
*H01H 33/14* (2006.01)

(56) References Cited

U.S. PATENT DOCUMENTS

| | | | | |
|---|---|---|---|---|
| 5,072,083 | A * | 12/1991 | Thuries et al. | 218/57 |
| 5,902,978 | A * | 5/1999 | Zehnder et al. | 218/57 |
| 6,211,478 | B1 * | 4/2001 | Schoenemann et al. | 218/16 |
| 6,429,394 | B2 * | 8/2002 | Hunger et al. | 218/155 |
| 2013/0161288 | A1 * | 6/2013 | Yamashita et al. | 218/47 |

FOREIGN PATENT DOCUMENTS

| | | | |
|---|---|---|---|
| JP | 59-073822 | A | 4/1984 |
| JP | 63-134972 | A | 6/1988 |
| JP | 2001-332158 | A | 11/2001 |
| JP | 2008-112633 | A | 5/2008 |
| JP | 2009-059541 | A | 3/2009 |

OTHER PUBLICATIONS

Written Opinion (PCT/ISA/237) mailed on Dec. 6, 2011, by the Japanese Patent Office as the International Searching Authority for International Application No. PCT/JP2011/069661.

Chinese Office Action dated Jun. 30, 2015 issued in corresponding Chinese Patent Appln. No. 201180072501.5, with partial English translation (7 pages).

* cited by examiner

GAS CIRCUIT BREAKER

FIELD

The present invention relates to a puffer type gas circuit breaker.

BACKGROUND

Conventionally, there are puffer type gas circuit breakers that are arranged in electric-supply stations, such as substations and switching stations, and extinguish an arc generated between contacts by spraying an insulating gas. An example of this type of gas circuit breaker is disclosed in Patent Literature 1 in which a gas circuit breaker includes, in a container filled with an insulating gas, a thermal puffer chamber, which is formed on the periphery of a movable-side contact (hereinafter, referred to also as a movable arcing contact) among arcing contacts, and mechanical puffer chambers formed adjacent to the thermal puffer chamber in a radial direction.

CITATION LIST

Patent Literature

Patent Literature 1: Japanese Patent Application Laid-open 2009-59541

SUMMARY

Technical Problem

Such a gas circuit breaker is expected to suppress an increase in temperature due to the flowing current and to improve the dissipation efficiency of generated heat.

The present invention is achieved in view of the above and has an object to obtain a gas circuit breaker that can suppress an increase in temperature due to the flowing current and improve the dissipation efficiency of generated heat.

Solution to Problem

In order to solve the above problem and achieve the object, the present invention includes a sealed tank that includes a first conductor container and a second conductor container, which are provided with an insulating tube therebetween, and that is filled with an insulating gas; a fixed arcing contact provided on the first conductor container side; a movable arcing contact that is provided on the second conductor container side and moves such that the movable arcing contact is capable of coming into contact with and separating from the fixed arcing contact; a fixed conductive contact provided on the first conductor container side; a movable conductive contact that moves in accordance with contact and separation of the movable arcing contact and comes into contact with and separates from the fixed conductive contact; and a puffer unit that is provided on the second conductor container side and has a mechanical puffer chamber formed therein, the mechanical puffer chamber being formed by a cylinder that accommodates therein the movable conductive contact, wherein the puffer unit is arranged between the insulating tube and the second conductor container and is exposed to an outer periphery of the sealed tank.

Advantageous Effects of Invention

According to the present invention, the puffer unit is exposed to the outside of the sealed tank; therefore, the generated heat can be easily dissipated to the outside via the puffer unit. Thus, it is possible to suppress an increase in temperature and improve the dissipation efficiency.

DESCRIPTION OF EMBODIMENTS

A gas circuit breaker according to embodiments of the present invention will be explained below in detail with reference to the accompanying drawings. The present invention is not limited to the embodiments.

First Embodiment

Figure 1:
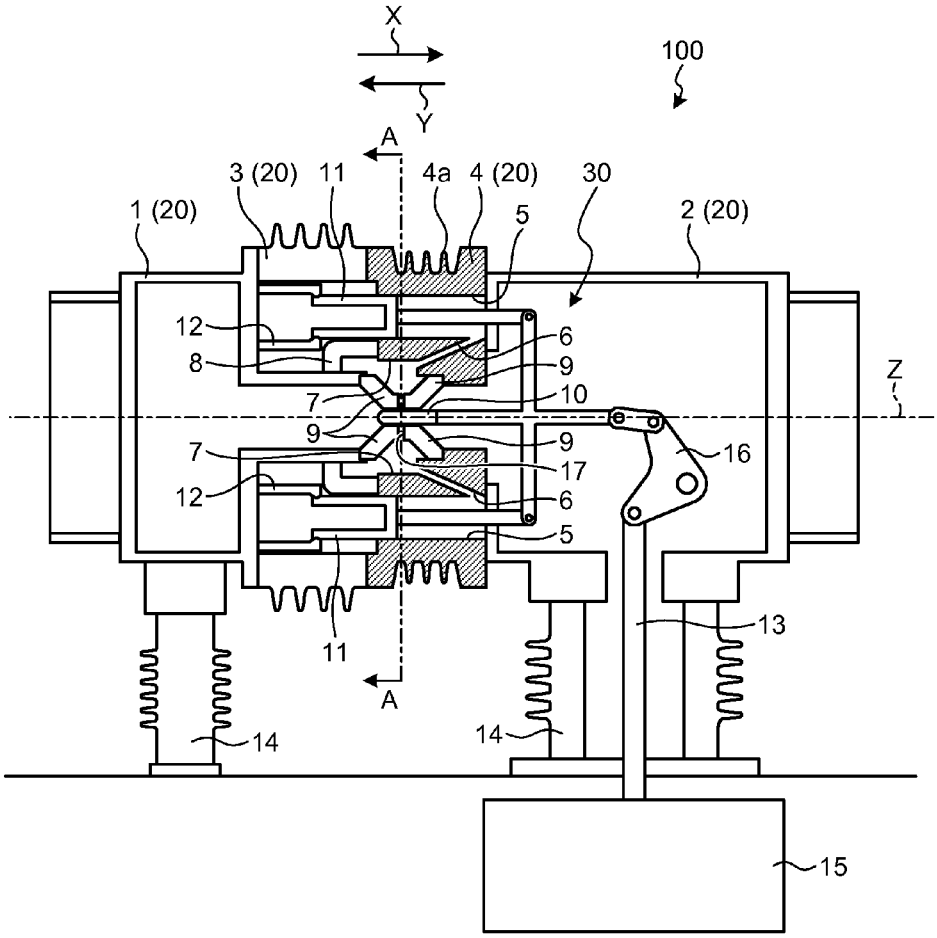
FIG. 1 is a cross-sectional view illustrating an energized state of a gas circuit breaker according to a first embodiment of the present invention.
Figure 2:
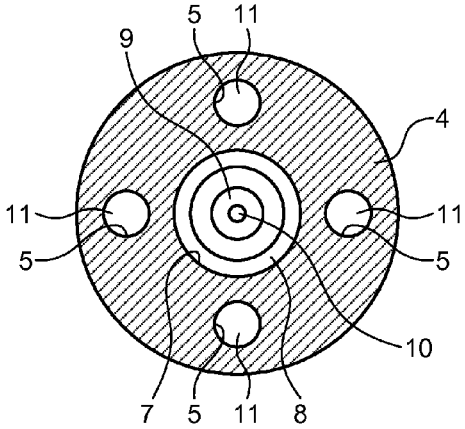
FIG. 2 is a cross-sectional view taken along line A-A in FIG. 1.

FIG. 1 is a cross-sectional view illustrating an energized state of a gas circuit breaker according to the first embodiment of the present invention. FIG. 2 is a cross-sectional view taken along line A-A in FIG. 1. In FIG. 1, components other than a puffer unit 4 are illustrated without hatching.

A gas circuit breaker 100 includes a sealed tank 20 and a switching unit 30. The sealed tank 20 includes a fixed-side cylindrical conductor (first conductor container) 1, a movable-side cylindrical conductor (second conductor container) 2, an insulating tube 3, and the puffer unit 4, and has a sealed space formed therein. The switching unit 30 is accommodated in this sealed space.

The fixed-side cylindrical conductor 1, the movable-side cylindrical conductor 2, and the puffer unit 4 are made of conductors, such as metal. The fixed-side cylindrical conductor 1 and the movable-side cylindrical conductor 2 are arranged with the insulating tube 3 therebetween. The puffer unit 4 is arranged so as to be interposed between the movable-side cylindrical conductor 2 and the insulating tube 3.

The insulating tube 3 is made of an insulating material, such as epoxy resin. The insulating tube 3 is provided between the fixed-side cylindrical conductor 1 and the puffer unit 4 and prevents current from directly flowing between the movable-side cylindrical conductor 2 and the puffer unit 4 and the fixed-side cylindrical conductor 1.

The sealed tank 20 is filled with an insulating gas, such as sulfur hexafluoride ($SF_6$). The sealed tank 20 is supported by support insulators 14. An operating device 15 is provided below the sealed tank 20. The switching operation of the switching unit 30 is performed by the operating device 15 via an insulated operation rod 13 formed by an insulating member and a link mechanism 16.

Next, the switching unit 30 is explained. The switching unit 30 includes fixed conductive contacts 12, movable conductive contacts 11, a fixed arcing contact 9, and a movable arcing contact 10. The fixed conductive contacts 12 are electrically connected to the fixed-side cylindrical conductor 1. The movable conductive contacts 11 are provided facing the fixed conductive contacts 12.

The movable conductive contacts 11 are connected to the link mechanism 16 and can be reciprocated in the directions indicated by the arrows X and Y by the operating device 15. Because the movable conductive contacts 11 reciprocate, they can come into contact with and separate from the fixed conductive contacts 12. As illustrated in FIG. 1 and FIG. 2, the movable conductive contacts 11 are cylindrical pistons.

The fixed arcing contact 9 is electrically connected to the fixed-side cylindrical conductor 1. The movable arcing contact 10 is provided facing the fixed arcing contact 9. In a similar manner to the movable conductive contacts 11, the movable arcing contact 10 is connected to the link mechanism 16 and can be reciprocated by the operating device 15 in the directions indicated by the arrows X and Y along an axis line Z in conjunction with the movable conductive contacts 11.

Because the movable arcing contact 10 reciprocates, it can come into contact with and separate from the fixed arcing contact 9. The movable arcing contact 10 is configured such that, during the process of moving in the direction indicated by the arrow X, the movable arcing contact 10 separates from the fixed arcing contact 9 after the movable conductive contacts 11 separate from the fixed conductive contacts 12.

Next, the puffer unit 4 is explained. The puffer unit 4 has mechanical puffer chambers 5 formed therein as cylinders that accommodate therein the movable conductive contacts 11. The volume of the mechanical puffer chamber 5 changes due to the movement of the movable conductive contact 11. Particularly, when the movable conductive contact 11 moves in a direction that separates it from the fixed conductive contact 12 (direction indicated by the arrow X), the volume of the mechanical puffer chamber 5 decreases.

Moreover, the puffer unit 4 forms a thermal puffer chamber 7 around the fixed arcing contact 9. Specifically, part of the walls that form the thermal puffer chamber 7 is formed by the puffer unit 4. The thermal puffer chamber 7 is formed as a space surrounded by the puffer unit 4, the fixed-side cylindrical conductor 1, the fixed arcing contact 9, and an insulator 8.

The insulator 8 closes the gap between the puffer unit 4 and the fixed-side cylindrical conductor 1. The insulator 8 closes the gap between the puffer unit 4 and the fixed conductive contacts 12. A clearance is provided between the fixed conductive contacts 12 and the insulator 8 and this clearance is an outlet 17 from which an insulating gas is blown toward the portion (hereinafter, referred to as an arc generation region) near the contact portion in which the fixed arcing contact 9 and the movable arcing contact 10 are in contact with each other.

Moreover, the puffer unit 4 has blowoff flow paths 6 formed therein. The blowoff flow paths 6 cause the mechanical puffer chambers 5 and the thermal puffer chamber 7 to communicate with each other. The outer periphery of the puffer unit 4 is exposed to the outside of the sealed tank 20. A fin-shaped heat dissipation fin 4*a* is formed on the outer periphery of the puffer unit 4.

The whole puffer unit 4 is formed as one unit. Particularly, the portion that forms the mechanical puffer chambers 5 and the portion that forms the thermal puffer chamber 7 are integrally formed. Consequently, the movable-side cylindrical conductor 2 and the movable conductive contacts 11 are electrically connected to each other by the puffer unit 4, which is a conductor formed as one unit.

Next, the current breaking operation of the gas circuit breaker 100 is explained. First, the movable conductive contacts 11 separate from the fixed conductive contacts 12. Then, the movable arcing contact 10 separates from the fixed arcing contact 9. Due to this separation operation, an arc is generated in the arc generation region between the movable arcing contact 10 and the fixed arcing contact 9.

During the current breaking in a high-current region, the insulating gas in the arc generation region is heated and its pressure is increased, due to the arc energy, and it is then accumulated in the thermal puffer chamber 7. Thereafter, when a current zero point is approached, the heat and pressure in the arc generation region decrease; therefore, the high-pressure insulating gas accumulated in the thermal puffer chamber 7 is blown from the outlet 17 and is sprayed in an arc in the arc generation region, whereby the arc is extinguished and thus current interruption is performed.

Moreover, the volume of the mechanical puffer chambers 5 decreases in accordance with the separation operation of the movable conductive contacts 11. At his point, the insulating gas in the mechanical puffer chambers 5 is compressed and cold insulating gas flows into the thermal puffer chamber 7 through the blowoff flow paths 6. Consequently, the pressure of the thermal puffer chamber 7 increases and the insulating gas is blown from the outlet 17 and is sprayed in the arc generation region, whereby the arc is extinguished and thus current interruption is performed.

During the current breaking in a medium- and low-current region, because the insulating gas in the arc generation region is heated less, the pressure of the thermal puffer chamber 7 is not greatly increased. Meanwhile, in the mechanical puffer chambers 5, the insulating gas is compressed in accordance with the separation operation of the movable conductive contacts 11 regardless of whether the insulating gas is heated or not. Therefore, the insulating gas is sprayed in the arc generation region, whereby the arc is extinguished and thus current interruption is performed, and the insulation performance is recovered.

For flowing (applying) current, the movable arcing contact 10 is connected to the fixed arcing contact 9 and then, the movable conductive contacts 11 are connected to the fixed conductive contacts 12, whereby current flows. Conductors in the current flow path generate heat due to their electrical resistance.

In the gas circuit breaker 100 according to the first embodiment, the puffer unit 4 is arranged between the insulating tube 3 and the movable-side cylindrical conductor 2 and the outer periphery of the puffer unit 4 is exposed to the outside of the sealed tank 20. Therefore, the heat generated due to the current flow can be easily dissipated to the outside via the puffer unit 4. Moreover, because the heat dissipation fin 4*a* is formed on the outer periphery of the puffer unit 4, the heat dissipation area is increased by increasing the contact area with the outer air. Accordingly, the cooling effect can be improved.

Moreover, because the puffer unit 4 is provided such that it is exposed to the outside of the sealed tank 20, the puffer unit 4 is easily formed as a large unit. Consequently, the current flowing area in the puffer unit 4 is increased; therefore, the electrical resistance can be reduced. A decrease in the electrical resistance enables heat generated in the puffer unit 4 to be reduced.

Moreover, in the puffer unit 4, the mechanical puffer chambers 5, the thermal puffer chamber 7, and the blowoff flow paths 6 are formed, and the puffer unit 4 is formed as one unit. With such a configuration, conductors between the movable-side cylindrical conductor 2 and the movable conductive contacts 11 in the current flow path can be formed by only the puffer unit 4. Accordingly, connection portions at which conductors are connected with each other can be reduced; therefore, the electrical resistance can be reduced. A decrease in the electrical resistance enables heat generated in the puffer unit 4 to be reduced.

Moreover, because conductors between the movable-side cylindrical conductor 2 and the movable conductive contacts 11 in the current flow path are formed by only the puffer unit 4, the number of components can be reduced. Accordingly, the manufacturing cost can be reduced.

Figure 3:
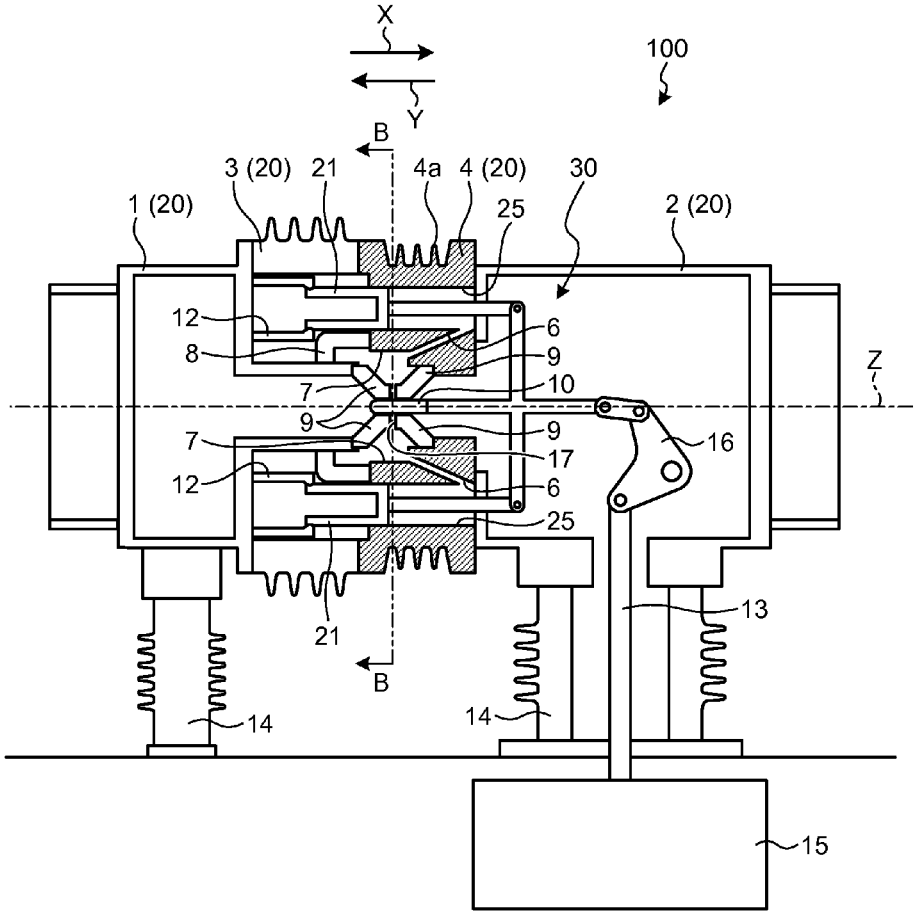
FIG. 3 is a cross-sectional view of a gas circuit breaker according to a first modified example of the first embodiment.
Figure 4:
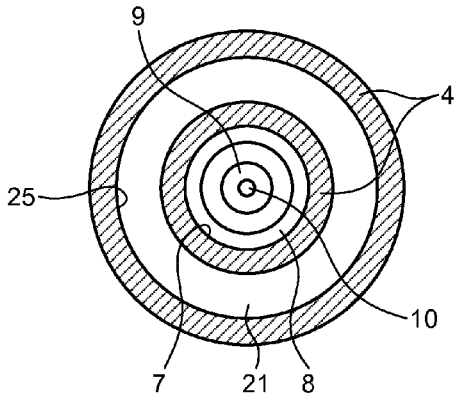
FIG. 4 is a cross-sectional view taken along line B-B in FIG. 3.

FIG. 3 is a cross-sectional view of the gas circuit breaker 100 according to a first modified example of the first embodiment. FIG. 4 is a cross-sectional view taken along line B-B in FIG. 3. In FIG. 4, components other than the puffer unit 4 are illustrated without hatching.

In the first modified example, a movable conductive contact 21 has a circular shape around the axis line Z. Therefore, a mechanical puffer chamber 25, which is a cylinder in which the movable conductive contact 21 is accommodated, also has a circular shape around the axis Z.

The movable conductive contact 21 and the mechanical puffer chamber 25 are formed so as to have a circular shape as described above; therefore, the distance from the axis line Z to the outermost portion of the mechanical puffer chamber can be shortened compared with the case where a plurality of cylindrical mechanical puffer chambers are arranged. Thus, the gas circuit breaker 100 can be reduced in size in the circumferential direction.

When the mechanical puffer chamber 25 is formed so as to have a circular shape, in some cases, the puffer unit 4 is formed by separate conductors on the inner side and outer side of the mechanical puffer chamber 25. In such a case, although a plurality of conductors are provided between the movable-side cylindrical conductor 2 and the movable conductive contacts 11 in the current flow path, the current flowing area in the puffer unit 4 can be increased by exposing the puffer unit 4 to the outside of the sealed tank 20. Accordingly, the electrical resistance can be reduced.

Second Embodiment

Figure 5:
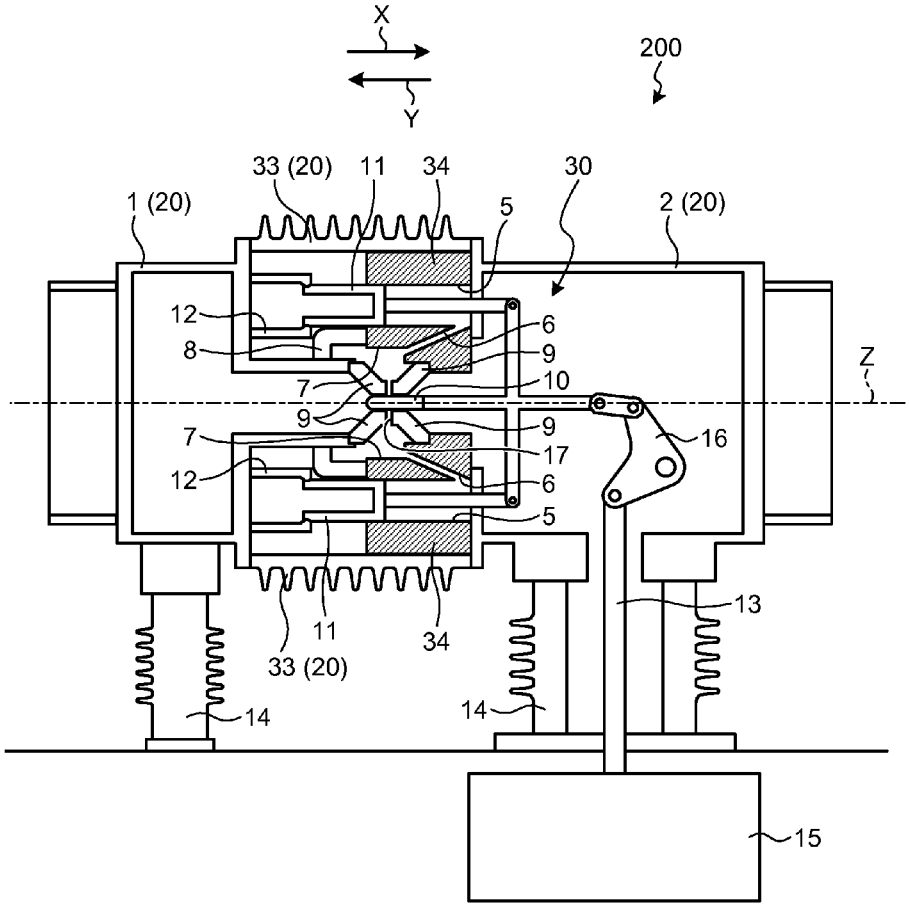
FIG. 5 is a cross-sectional view illustrating an energized state of a gas circuit breaker according to a second embodiment of the present invention.

FIG. 5 is a cross-sectional view illustrating an energized state of a gas circuit breaker according to the second embodiment of the present invention. Configurations that are the same as those in the above embodiment are given the same reference numerals and a detailed explanation thereof is omitted.

In a gas circuit breaker 200 according to the second embodiment, the sealed tank 20 is formed by the fixed-side cylindrical conductor 1, the movable-side cylindrical conductor 2, and an insulating tube 33. Therefore, the insulating tube 33 is directly in contact with the movable-side cylindrical conductor 2.

Because the insulating tube 33 is directly in contact with the movable-side cylindrical conductor 2, the insulating tube 33 closes the space between the fixed-side cylindrical conductor 1 and the movable-side cylindrical conductor 2. Therefore, a puffer unit 34 is arranged on the inner side of the insulating tube 33 and is not exposed to the outside of the sealed tank 20. However, in the second embodiment, the current flowing area in the puffer unit 34 can be increased by forming the puffer unit 34 such that it closes the space between the movable conductive contacts 11 and the insulating tube 33. Accordingly, the electrical resistance can be reduced.

Moreover, conductors between the movable-side cylindrical conductor 2 and the movable conductive contacts 11 in the current flow path are formed by only the puffer unit 34. Accordingly, connection portions at which conductors are connected with each other can be reduced; therefore, the electrical resistance can be reduced. A decrease in the electrical resistance enables heat generated in the puffer unit 34 to be reduced.

Moreover, because conductors between the movable-side cylindrical conductor 2 and the movable conductive contacts 11 in the current flow path are formed by only the puffer unit 34, the number of components can be reduced. Accordingly, the manufacturing cost can be reduced.

INDUSTRIAL APPLICABILITY

As described above, the gas circuit breaker according to the present invention is useful as a gas circuit breaker in which a sealed container is filled with an insulating gas.

REFERENCE SIGNS LIST

1 fixed-side cylindrical conductor (first conductor container)
2 movable-side cylindrical conductor (second conductor container)
3 insulating tube
4 puffer unit
4*a* heat dissipation fin
5 mechanical puffer chamber
6 blowoff flow path
7 thermal puffer chamber
8 insulator
9 fixed arcing contact
10 movable arcing contact
11 movable conductive contact
12 fixed conductive contact
13 insulated operation rod
14 support insulator
15 operating device
16 link mechanism
17 outlet
20 sealed tank
21 movable conductive contact
25 mechanical puffer chamber
30 switching unit
33 insulating tube
34 puffer unit
100, 200 gas circuit breaker
X, Y arrow
Z axis line

The invention claimed is:

1. A gas circuit breaker comprising:

a sealed tank that includes a first conductor container and a second conductor container, which are provided with an insulating tube therebetween, and that is filled with an insulating gas;

a fixed arcing contact provided on the first conductor container side;

a movable arcing contact that is provided on the second conductor container side and moves such that the movable arcing contact is capable of coming into contact with and separating from the fixed arcing contact;

a fixed conductive contact provided on the first conductor container side;

a movable conductive contact that moves in accordance with contact and separation of the movable arcing contact and comes into contact with and separates from the fixed conductive contact; and a puffer unit that is provided on the second conductor container side and has a mechanical puffer chamber formed therein, the mechanical puffer chamber being formed by a cylinder that accommodates therein the movable conductive contact, wherein the puffer unit is arranged between the insulating tube and the second conductor container and is exposed to an outer periphery of the sealed tank, and a fin is formed on an outer periphery of the puffer unit.

2. The gas circuit breaker according to claim 1, wherein the puffer unit forms at least part of a thermal puffer chamber that surrounds a contact-and-separation portion of the movable arcing contact and the fixed arcing contact.

3. The gas circuit breaker according to claim 2, wherein a blowoff flow path is formed in the puffer unit, the blowoff flow path causing the mechanical puffer chamber and the thermal puffer chamber to communicate with each other.

4. The gas circuit breaker according to claim 2, wherein the puffer unit is such that a portion forming the mechanical puffer chamber and a portion forming the thermal puffer chamber are integrally formed, and the second conductor container and the movable conductive contact are electrically connected to each other by the puffer unit.

5. The gas circuit breaker according to claim 1, wherein the movable conductive contact and the mechanical puffer chamber have a circular shape around an axis line of the movable arcing contact.

6. A gas circuit breaker comprising:

a sealed tank that includes a first conductor container and a second conductor container, which are provided with an insulating tube therebetween, and that is filled with an insulating gas;

a fixed arcing contact provided on the first conductor container side;

a movable arcing contact that is provided on the second conductor container side and moves such that the movable arcing contact is capable of coming into contact with and separating from the fixed arcing contact;

a fixed conductive contact provided on the first conductor container side;

a movable conductive contact that moves in accordance with contact and separation of the movable arcing contact and comes into contact with and separates from the fixed conductive contact; and a puffer unit that is provided on the second conductor container side and has a mechanical puffer chamber formed therein, the mechanical puffer chamber being formed by a cylinder that accommodates therein the movable conductive contact, wherein the puffer unit is arranged on an inner side of the insulating tube and closes a space between the movable conductive contact and the insulating tube.

* * * * *